US005277633A

United States Patent [19]

Kato et al.

[11] Patent Number: 5,277,633

[45] Date of Patent: Jan. 11, 1994

[54] COWLING FOR A MARINE PROPULSION ENGINE

[75] Inventors: Hideki Kato; Hitoshi Ishida, both of Hamamatsu, Japan

[73] Assignee: Sanshin Kogyo Kabushiki Kaisha, Japan

[21] Appl. No.: 879,998

[22] Filed: May 8, 1992

[30] Foreign Application Priority Data

May 9, 1991 [JP] Japan ..... 3-132143

[51] Int. Cl.[5] ..... B63H 21/26

[52] U.S. Cl. ..... 440/77; 123/195 P

[58] Field of Search ..... 440/76, 77, 88, 900; 123/195P, 198E

[56] References Cited

U.S. PATENT DOCUMENTS 4,632,662 12/1986 Handa ..... 440/77
4,869,693 9/1989 Curtis et al. ..... 440/77
5,052,960 10/1991 Kato ..... 440/77
5,069,644 12/1991 Kobayashi et al. ..... 440/77

FOREIGN PATENT DOCUMENTS 120598 7/1984 Japan ..... 440/77
2-147496 2/1990 Japan .

*Primary Examiner*—David M. Mitchell
*Assistant Examiner*—Stephen P. Avila
*Attorney, Agent, or Firm*—Bacon & Thomas

[57] ABSTRACT

A cowling structure for a marine propulsion engine is disclosed which effectively prevents water from entering the air intake opening, while at the same time maintains optimum engine performance. The cowling structure has an engine cowl which encloses the engine and which defines an air intake opening. An air duct molding is associated with the engine cowl such that it extends over the air intake opening and, in conjunction with the engine cowl, defines an air inlet facing toward a rear portion of the cowling structure. A wall extends between the engine cowl and the air duct molding and is located between the air intake opening and the air inlet. Sidewalls, which are spaced apart a distance less than the width of the wall, direct any water entering the air inlet towards the wall to effectively prevent the water from entering the air intake opening.

11 Claims, 3 Drawing Sheets

COWLING FOR A MARINE PROPULSION ENGINE

BACKGROUND OF THE INVENTION

This invention relates to a cowling structure for a marine propulsion engine, more particularly a cowling structure which prevents water from entering the air intake opening.

Marine propulsion engines, such as outboard engines, are well-known in the art. Such outboard engines typically have a cowling which encloses the engine. It is necessary for the cowling to define an air inlet to enable air to pass through the cowling and into the engine.

The engine cowlings usually define the air inlet at a rear portion and may utilize the air inlet opening to also form a grip opening which is useful when tilting up the outboard engine.

While the known cowling structures have been generally successful, they have provided insufficient protection form water entering the air inlet from following waves. Water passing through the air inlet may also pass through the air intake opening and into the engine itself. Attempts have been made to change the shape of the air duct which transports air from the air inlet to the intake opening, but these attempts have restricted the volume of the air duct such that, if sufficient water entry protection is obtained, the engine performance is diminished. The result of these attempts is that water could not effectively be prevented from entering the air intake opening while still maintaining maximum engine performance.

SUMMARY OF THE INVENTION

The present invention provides a cowling structure for a marine propulsion engine which effectively prevents water from entering the air intake opening, while at the same time maintains optimum engine performance. The cowling structure has an engine cowl which encloses the engine and which defines an air intake opening. An air duct molding is associated with the engine cowl such that it extends over the air intake opening and, in conjunction with the engine cowl, defines an air inlet facing toward a rear portion of the cowling structure.

A wall extends between the engine cowl and the air duct molding and is located between the air intake opening and the air inlet. Sidewalls, which are spaced apart a distance less than the width of the wall, direct any water entering the air inlet towards the wall. This effectively prevents the water from entering the air intake opening. Air entering the air inlet may pass around the wall so that it may be drawn into the air intake opening. Additional air may enter the cowling structure through gaps between the sides of the air duct molding and the engine cowl.

Water contacting the wall will be directed rearwardly such that it exits from the air inlet. According to the concepts of this invention, it is not necessary to make the air inlet opening smaller in order to prevent the water from entering the air intake opening. This allows engine performance to be maximized, while at the same time, positively prevents the water from entering the air intake opening.

DETAILED DESCRIPTION OF THE PREFERRED EMBODIMENTS

Figure 5:
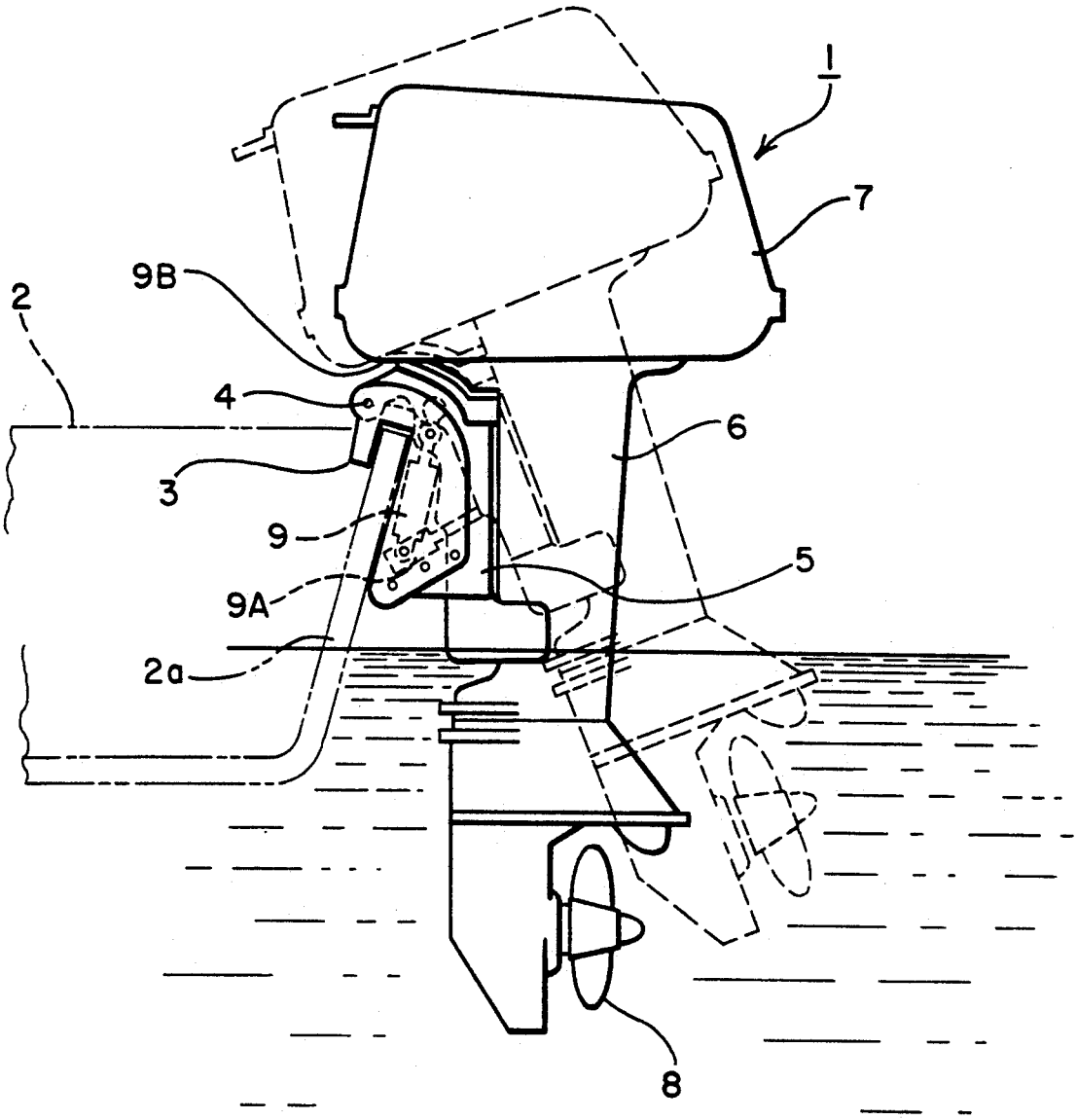
FIG. 5 is a partial, side view of an outboard engine incorporating the cowling structure according to the present invention attached to a boat transom.

As best illustrated in FIG. 5, outboard engine 1 is attached to the transom 2*a* of boat hull 2 by means of a clamp bracket 3. A swivel bracket 5 attached between the outboard engine 1 and the clamp bracket 3 allows the outboard engine 1 to be tilted upwardly about shaft 4 with respect to the boat hull 2. The swivel bracket 5 is attached to the drive unit 6 of the outboard engine 1 in known fashion. Also in known fashion, outboard engine 1 includes an engine unit 7 and a propulsion unit 8.

A tilt cylinder 9 allows the engine to be tilted up or down on swivel bracket 5. The tilting mechanism also includes two trim cylinders 9A which may be used to adjust the trim of the engine via the swivel bracket 5. A steering bracket 9B is also provided which moves the outboard engine left or right to steer the boat in response to rotation of a steering shaft (not shown).

Figure 1:
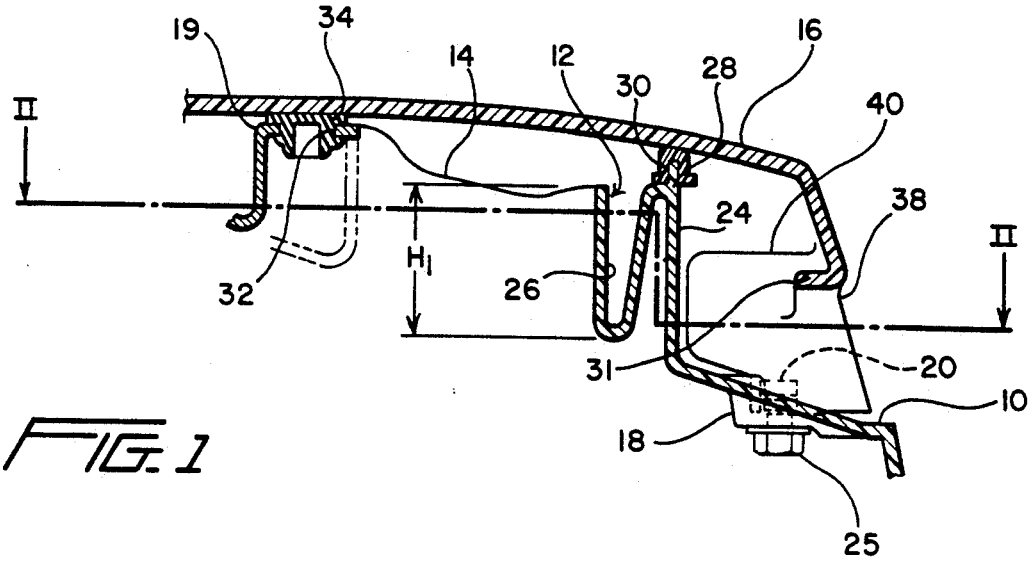
FIG. 1 is a partial, longitudinal, cross-sectional view of the cowling structure according to the present invention.
Figure 2:
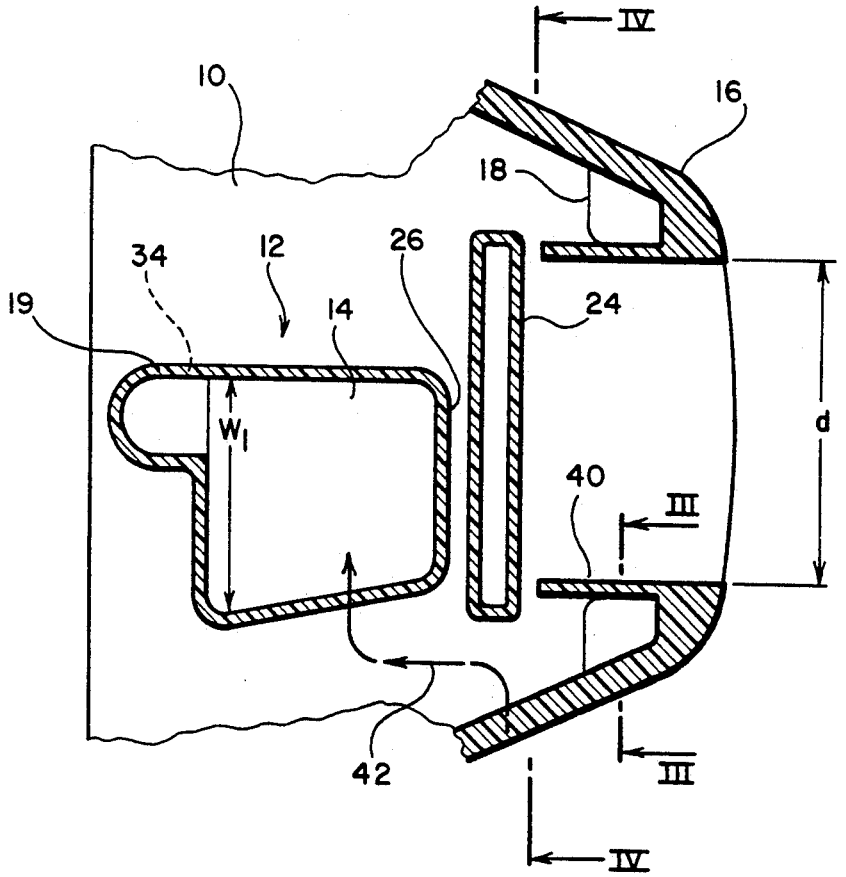
FIG. 2 is a cross-sectional view taken along line, II—II in FIG. 1.

Cross-sections of an upper rear portion of the engine unit 7 are illustrated in FIGS. 1 and 2. Engine cowl 10, which may enclose the marine propulsion engine, has an air duct 12 which defines air intake opening 14. As illustrated in FIG. 2, air intake opening 14 may have a generally square configuration.

Figure 3:
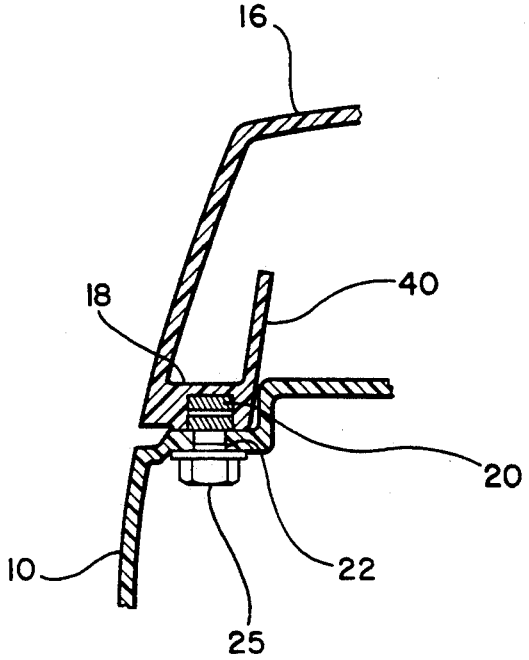
FIG. 3 is a cross-sectional view taken along line III—III in FIG. 2.

Air duct molding 16 is affixed to engine cowl 10 so that it extends over air duct 12 and air intake opening 14. As best seen in FIG. 3, the air duct molding is attached to the engine cowl 10 by a pair of bolts 20 which may be embedded in a boss 18 formed on a lower side of the air duct molding 16. Bolts 20 extend through bolt holes 22 defined in a side edge of the engine cowl 10. Nuts 25 are threaded onto the bolts 22 from the back of the engine cowl 10 in order to hold these elements together.

Wall 24, best seen in FIGS. 1 and 2, functions as a water dike to prevent water from entering the air intake opening 14. Wall 24 may be formed integrally with the engine cowl 10 by a portion extending upwardly toward the air duct molding 16. Wall 24 extends generally parallel to a rear surface 26 of the air duct 12 and is located between the air intake opening 14 and an air inlet 38. Wall 24 may have an upper edge portion that is located adjacent to an inner surface of air duct molding 16. A flange 28 may extend upwardly from this upper edge portion and may be used to attach rubber seal 30 to the wall 24. Rubber seal 30 contacts the inner surface of the air duct molding 16 so as to prevent water from passing between these elements, and to elastically support and reinforce the air duct molding 16. The wall 24 has a width $W_2$ that is equal to or greater than the width $W_1$ of the air intake opening 14.

A portion of a forward side of the air intake duct 12 defines a generally semi-cylindrical protrusion 19 which defines an opening 32 to accommodate rubber grommet 34. Grommet 34, similar to rubber seal 30, elastically contacts the inner surface of the air duct molding 16, as illustrated in FIG. 1.

A rear portion of the air duct molding 16 has a cut out portion with an inner edge 31. This cut out portion of air duct molding 16, along with the rear portion of engine cowl 10, defines the air inlet opening 38. Opening 38 also services as a grip to tilt the outboard engine upwardly. A pair of sidewalls 40 extend along opposite sides of opening 38 and may be formed integrally with the air duct molding 16. The sidewalls 40 project toward the wall 24 and may extend generally perpendicular to the wall. Sidewalls 40 may also be formed integrally with the bosses 18, as best illustrated in FIG. 3. The sidewalls 40 serve to provide structural reinforcement to the bosses 18.

Figure 4:
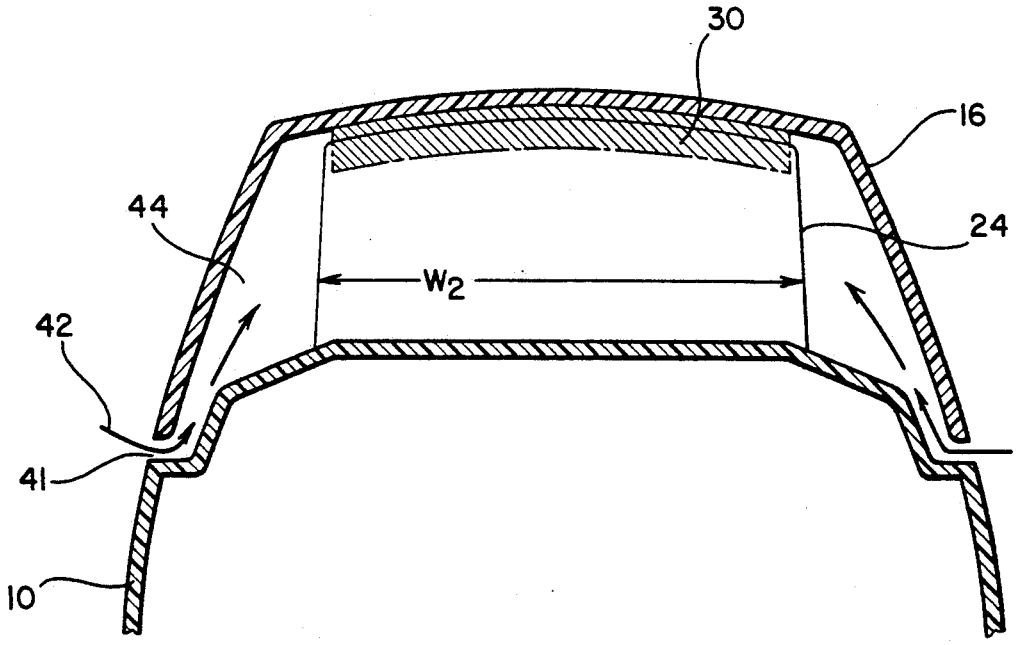
FIG. 4 is a cross-sectional view taken along line IV—IV in FIG. 2.

Opposite sides of the air duct molding 16 and the engine cowl 10 define gaps 41 which allow additional air to enter the cowling structure. As can be seen in FIG. 4, air 42 enters the gaps 41 and travels upwardly through air passage 44 until reaching the air intake opening 14.

In operation, water entering the air inlet 38, due to a following wave or the like, is guided by the sidewalls 40 such that it contacts wall 24. The distance d between the sidewalls 40 is equal to or less than the width $W_2$ of the wall 24. The height of wall 24 is also greater than the height of the air intake duct 12 so as to positively prevent water from entering the air intake duct. Furthermore, the top of wall 24 is sealed by rubber seal 30 to prevent water from traveling over top of the wall.

Even if water hitting the wall 24 is deflected toward the sides, the sidewalls 40 are oriented so as to prevent water from entering the air intake opening 14. The sidewalls 40 also are oriented so as to prevent any water from entering the air passage 44, best seen in FIG. 4, along which the air 42 entering the gaps 41 passes. A rear wall portion of engine cowl 10 defines the lower surface of air inlet opening 38 and is sloped downwardly towards the air inlet opening, as illustrated in FIG. 1, to direct water back out through the air inlet 38.

Thus, as can be seen, the cowling structure according to this invention positively prevents water from entering the air intake opening 14. This is accomplished without decreasing the size of the air inlet or the air intake opening and, therefore, the marine engine performance is not diminished.

In recent years there has been a strong demand for lighter weight marine propulsion engines, which has resulted in the fabrication of engine cowlings, particularly the air duct molding, from resins rather than metal. However, when air duct moldings are made of resin, their structural strength is lessened and they may be easily dented or broken. In the cowling structure according to this invention, the wall 24, through the seal 30, contacts an inner surface of the air duct molding 16 to serve as a structural reinforcement for this air duct molding to prevent damage. Additionally, grommet 34 positioned between the air duct 12 and the air duct molding 16 also serves to structurally support and reinforce the air duct molding 16. Therefore, with these structural reinforcements, even if a load is placed on the air duct molding 16, there is sufficient strength such that it does not dent or warp. Also, these reinforcing members serve to absorb vibrations between the engine cowl 10 and the air duct molding 16.

The required volume of air intake is assured, even if the air inlet opening 38 is made smaller, since air may also enter through the gaps 41. Thus, reducing the size of the air inlet opening 38 will not detract from the overall air intake of the cowling structure. Gaps 41 also serve as an outlet for water in the unlikely event that water could somehow enter the passageways 44.

In the aforedescribed embodiment, wall 24 was described as constituting an integral part of the engine cowl 10. It is to be understood that wall 24 could also be separately formed from the engine cowl 10 and, furthermore, this wall could also be integrally formed with the air duct molding 16 such that it extends downwardly towards the upper surface of the engine cowl 10. In this instance, the seal 30 would be provided between the edge of the wall and the upper surface of the engine cowl 10.

It is also possible to eliminate the seal 30 from the cowling structure without exceeding the scope of this invention. In this instance, as long as the height of the wall 24 was sufficient to prevent entry of water, seal 30 could be eliminated.

Sidewalls 40 may be formed separately from the air duct molding 16 and the boss members 18. Sidewalls 40 could also be mounted on engine cowl 10, or they could project rearwardly from wall 24. While in the described embodiment, sidewalls 40 extend generally perpendicular to wall 24, there are no particular limitations upon the angle at which they may be mounted. The cowling structure according to this invention is not limited on the angle of wall 24, as long as it prevents water from entering the air intake opening. Also, other shapes of air intake openings and air inlets may be utilized without exceeding the scope of this invention.

The foregoing description is provided for illustrative purposes only and should not be construed as in any way limiting this invention, the scope of which is defined solely by the appended claims.

We claim:

1. A cowling structure for a marine propulsion engine to prevent water from entering an air intake opening, comprising:

a) an engine cowl assembly defining an inlet and having an air duct with a height $H_1$, spaced from the air inlet, the air duct defining an air intake opening having width $W_1$;

b) wall means within the engine cowl assembly extending generally transversely across the space between the air inlet and air intake opening so as to block water passing through the air inlet from the air duct, thereby preventing water from entering the air intake opening, the wall means having a height dimension $H_2$ not less than $H_1$ and a transverse width dimension $W_2$ not less than $W_1$; and, c) sidewalls defining at least a portion of the air inlet, the sidewalls being spaced apart a distance d such that d is not greater than $W_2$.

2. The cowling structure of claim 1 wherein the sidewalls extend generally perpendicular to the wall means.

3. The cowling structure of claim 1 wherein the engine cowl assembly further comprises:

an air duct molding operatively associated with the engine cowl so as to define therewith the air inlet and so as to extend over the air intake opening.

4. The cowling structure of claim 3 wherein the sidewalls extend generally perpendicular to the wall means.

5. The cowling structure of claim 3 wherein the sidewalls are formed integrally with the air duct molding.

6. The cowling structure of claim 3 wherein the wall means extends upwardly from the engine cowl in a direction toward the air duct molding and defines an upper edge portion located adjacent to the air duct molding.

7. The cowling structure of claim 6 further comprising seal means operatively interposed between the upper edge portion of the wall member and the air duct molding.

8. The cowling structure of claim 7 wherein the seal means comprises a seal member attached to the upper edge portion of the wall means such that it contacts the air duct molding.

9. The cowling structure of claim 3 wherein the air duct molding and the engine cowl define therebetween at least one air gap to allow additional air to enter the air intake opening after passing through the at least one air gap.

10. The cowling structure of claim 9 wherein the air duct molding and the engine cowl have opposite sides, and wherein the air duct molding and the engine cowl define therebetween at least one air gap on each of the opposite sides.

11. The cowling structure of claim 3 wherein the air duct molding and the engine cowl have rear portions at which is defined the air inlet, and wherein the engine cowl further comprises a sloped wall portion defining a lower portion of the air inlet, the wall portion sloping downwardly toward the air inlet.

* * * * *